US011600906B2

(12) United States Patent
Chen et al.

(10) Patent No.: US 11,600,906 B2
(45) Date of Patent: Mar. 7, 2023

(54) MOUNTING ASSEMBLIES AND MOUNTING KIT FOR BASE STATION ANTENNAS

(71) Applicant: CommScope Technologies LLC, Hickory, NC (US)

(72) Inventors: Chen Chen, Jiangsu (CN); ZhaoHui Liu, Jiangsu (CN); Junfeng Yu, Jiangsu (CN); Xiaohua Tian, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/389,890

(22) Filed: Jul. 30, 2021

(65) Prior Publication Data

US 2022/0069447 A1 Mar. 3, 2022

(30) Foreign Application Priority Data

Aug. 31, 2020 (CN) ..... 202010892271.8

(51) Int. Cl.
*H01Q 1/22* (2006.01)
*H01Q 1/24* (2006.01)
*H01Q 1/12* (2006.01)

(52) U.S. Cl.
CPC ..... *H01Q 1/246* (2013.01); *H01Q 1/1207* (2013.01); *H01Q 1/1242* (2013.01); *H01Q 1/1264* (2013.01)

(58) Field of Classification Search
CPC ..... H01Q 1/24; H01Q 1/246; H01Q 1/12; H01Q 1/1207; H01Q 1/1242; H01Q 1/1264; H01Q 1/22
See application file for complete search history.

(56) References Cited

U.S. PATENT DOCUMENTS 5,440,318 A * 8/1995 Butland ..... H01Q 21/08 343/822
2020/0194884 A1* 6/2020 Clifford ..... H01Q 1/125
(Continued)

FOREIGN PATENT DOCUMENTS

CN 101944648 B 6/2013
CN 106910974 A 6/2017
(Continued)

OTHER PUBLICATIONS

"Extended European Search Report corresponding to European Application No. 21190738.1 dated Feb. 2, 2022".

*Primary Examiner* — Blane J Jackson
(74) *Attorney, Agent, or Firm* — Myers Bigel, P.A.

(57) ABSTRACT

The present disclosure relates to a mounting assembly and a mounting kit comprising such a mounting assembly for a base station antenna, wherein the mounting assembly has first and second connection parts, an effective length therebetween is related to the mechanical tilt of the base station antenna, and the effective length is continuously adjustable. The mounting assembly comprises a connecting rod mechanism having a first pair of connecting rods, a second pair of connecting rods, and a threaded connection device, wherein the threaded connection device connects two relatively movable hinged connection parts, the distance between the two hinged connection parts can be continuously adjusted by screwing the threaded connection device, so that the effective length can be continuously adjusted to realize continuous adjustment of the mechanical tilt of the base station antenna.

23 Claims, 6 Drawing Sheets

(56) References Cited

U.S. PATENT DOCUMENTS

| | | | | |
|---|---|---|---|---|
| 2021/0075083 | A1* | 3/2021 | Udagave | H01Q 1/1207 |
| 2021/0175598 | A1* | 6/2021 | Dembinski | H01Q 1/246 |

FOREIGN PATENT DOCUMENTS

| | | | | | |
|---|---|---|---|---|---|
| CN | 111048884 | A | | 4/2020 | |
| KR | 201600079421 | A | * | 7/2016 | H01Q 3/06 |

* cited by examiner

MOUNTING ASSEMBLIES AND MOUNTING KIT FOR BASE STATION ANTENNAS

RELATED APPLICATION

The present application claims priority from and the benefit of Chinese Patent Application No. 202010892271.8, filed Aug. 31, 2020, the disclosure of which is hereby incorporated by reference herein in full.

FIELD OF THE INVENTION

The present disclosure relates to the field of base station antennas, and more particularly, to mounting assemblies for base station antennas and a mounting kit for base station antennas.

BACKGROUND OF THE INVENTION

In a radio communication system, the transmission and reception of signals can be realized by base station antennas. The position of the base station antenna is important for radio communication network, which will affect the coverage of the base station antenna. Therefore, in the process of installing and using the base station antenna, the position of the base station antenna may need to be adjusted accordingly, so that the coverage area of the base station antenna can meet the requirements. In some cases, it is expected that the position of the base station antenna, such as the mechanical tilt, can be adjusted during use.

Typically, the antenna mounting device can comprise an upper mounting assembly and a lower mounting assembly, wherein the lower mounting assembly can provide a pivot point for the base station antenna, and the upper mounting assembly can have an adjustable effective length, so that the mechanical tilt of the base station antenna can be adjusted by adjusting this effective length. Typically, the effective length of the upper mounting assembly can be discretely adjusted, and thus the base station antenna can have a limited number of selectable mechanical tilts.

SUMMARY OF THE INVENTION

The present disclosure aims to provide mounting assemblies for a base station antenna and a mounting kit including such mounting assemblies, wherein continuous adjustment of the mechanical tilt of the base station antenna can be simply realized by the mounting assemblies.

According to the first aspect of the present disclosure, a mounting assembly for a base station antenna is proposed, which has a first connection part and a second connection part for directly or indirectly connecting with the base station antenna, the effective length between the first connection part and the second connection part is related to the mechanical tilt of the base station antenna, wherein the effective length is continuously adjustable, and the mounting assembly comprises a connecting rod mechanism comprising:

a first pair of connecting rods, such first pair of two connecting rods being hinged to each other; and a second pair of connecting rods, such second pair of two connecting rods being hinged to each other;

wherein a first connecting rod of the first pair and a third connecting rod of the second pair are hinged to each other or movably connected with a first mounting member;

a second connecting rod of the first pair and a fourth connecting rod of the second pair are hinged to each other or movably connected with a second mounting member;

wherein the mounting assembly also comprises:

a threaded connection device connecting two relatively movable articulated joints of the connecting rod mechanism, wherein the distance between the two relatively movable articulated joints can be continuously adjusted by rotating the threaded connection device, and thus the effective length between the first connection part and the second connection part can be continuously adjusted.

In this mounting assembly, the effective working length of the threaded connection device can be continuously changed by rotating the threaded connection device, for example, with the help of a manual wrench or an electric tool. In this way, the distance between the two relatively movable hinged connection parts can be continuously adjusted, so that the effective length between the first connection part and the second connection part can be continuously adjusted to continuously adjust the mechanical tilt of the base station antenna.

In some embodiments, the first connection part and the second connection part have first rotation axes parallel to each other.

In some embodiments, a plurality of hinged connection parts of the connecting rod mechanism have second rotation axes parallel to each other.

In some embodiments, the first rotation axes and the second rotation axes are parallel or perpendicular to each other.

In some embodiments, the first connecting rod and the third connecting rod are hinged to each other, and the second connecting rod and the fourth connecting rod are hinged to each other.

In some embodiments, the hinged connection parts of the first connecting rod and the third connecting rod and the hinged connection parts of the second connecting rod and the fourth connecting rod constitute the two hinged connection parts that move relatively.

In some embodiments, the first connecting rod and the third connecting rod constitute the first connection part and the second connection part at the ends facing away from the hinged connection parts thereof.

In some embodiments, the first connecting rod and the third connecting rod are movably connected with the first mounting member, and/or the first mounting member constitutes a second connection.

In some embodiments, the second connecting rod and the fourth connecting rod are movably connected with a second mounting member, and/or the second mounting member constitutes a first connection part.

In some embodiments, the hinged connection parts of the first connecting rod and the second connecting rod and the hinged connection parts of the third connecting rod and the fourth connecting rod constitute two hinged connection parts that move relatively.

In some embodiments, the first connecting rod and the third connecting rod are movably connected with the first mounting member through a first combined hinged connection part including a first U-shaped element, wherein the first connecting rod or the third connecting rod is pivotally hinged with two legs of the first U-shaped element around a second rotation axis, the first mounting member is pivotally hinged with the bottom of the first U-shaped element around a first rotation axis, and the first rotation axis is perpendicular to the second rotation axis.

In some embodiments, the second connecting rod and the fourth connecting rod are movably connected with a second mounting member through a second combined hinged connection part including a second U-shaped element, wherein the second connecting rod or the fourth connecting rod is pivotally hinged with two legs of the second U-shaped element in a pivotable manner around a second rotation axis, and the second mounting member is pivotally hinged with the bottom of the second U-shaped element around a first rotation axis, and the first rotation axis is perpendicular to the second rotation axis.

In some embodiments, the connecting rod mechanism comprises a first additional connecting rod having a long hole, wherein the first additional connecting rod is connected with one of four hinged connection parts, another of the four hinged connection parts can move in the long hole, and the four hinged connection parts comprise the hinged connection part between the first connecting rod and the first U-shaped element, that between the third connecting rod and the first U-shaped element, that between the second connecting rod and the second U-shaped element, and that between the fourth connecting rod and the second U-shaped element.

In some embodiments, the first additional connecting rod is connected with the hinged connection part between the fourth connecting rod and the second U-shaped element, and the hinged connection part between the first connecting rod and the first U-shaped element is movable in the long hole of the first additional connecting rod.

In some embodiments, the connecting rod mechanism comprises a second additional connecting rod having a long hole, which is connected with the hinged connection part between the second connecting rod and the second U-shaped element, and the hinged connection part between the third connecting rod and the first U-shaped element is movable in the long hole of the second additional connecting rod.

In some embodiments, the first mounting member has a plate-shaped bottom surface and two connecting legs protruding from the bottom surface, the first connecting rod is connected with one of the connecting legs, and the third connecting rod is connected with the other connecting leg.

In some embodiments, the second mounting member has a plate-shaped bottom surface and two connecting legs protruding from the bottom surface, the second connecting rod is connected with one of the connecting legs, and the fourth connecting rod is connected with the other connecting leg.

According to the second aspect of the present disclosure, a mounting kit for base station antenna is proposed, which comprises a first mounting assembly and a second mounting assembly, wherein the first mounting assembly is configured to provide a pivot point for the base station antenna on the derrick, and the second mounting assembly is the mounting assembly according to the first aspect of the present disclosure, and is configured to provide a continuously adjustable effective length between the base station antenna and the derrick, so that the mechanical tilt of the base station antenna can be continuously adjusted.

The technical characteristics mentioned above, the technical characteristics to be mentioned below, and the technical characteristics which may be obtained from the drawings may be combined arbitrarily as long as these technical characteristics do not conflict with each other. All technically feasible feature combinations are included in this disclosure.

BRIEF DESCRIPTION OF THE DRAWINGS

The present disclosure will be explained in more detail by means of embodiments with reference to the attached drawings. Among them.

DESCRIPTION OF THE EMBODIMENTS

Figure 3:
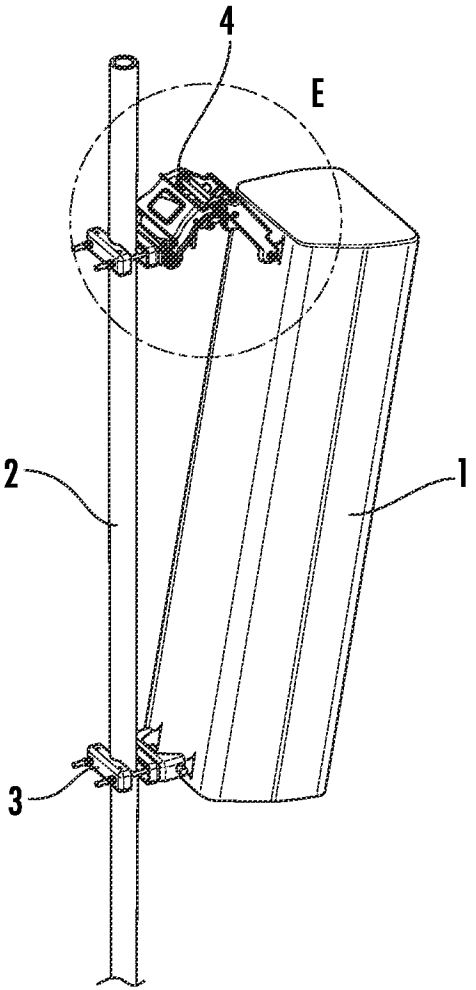
FIG. 2 and FIG. 3 are side views and perspective views of the base station antenna system of FIG. 1 with a certain mechanical tilt.
Figure 2:
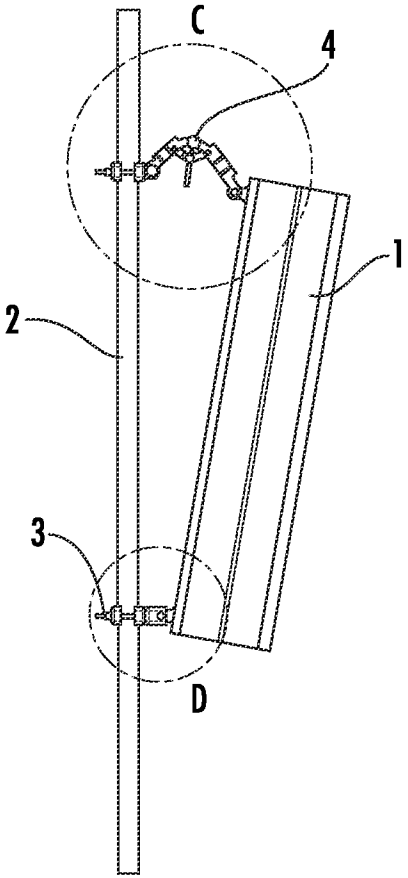
Figure 1:
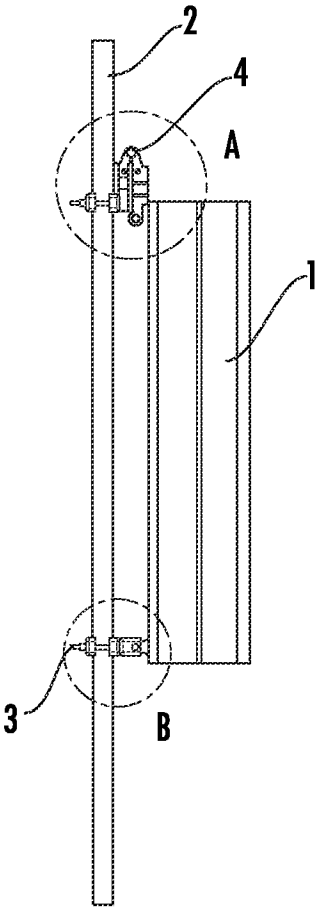
FIG. 1 is a side view of the base station antenna system with the mounting assembly according to the first embodiment of the present disclosure when the mechanical tilt is zero.
Figure 4A:
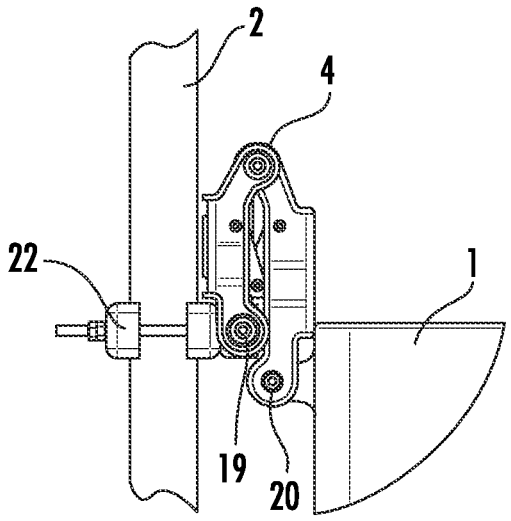
FIGS. 4A to 4F are detailed views of insets A to E in FIGS. 1 to 3.
Figure 4B:
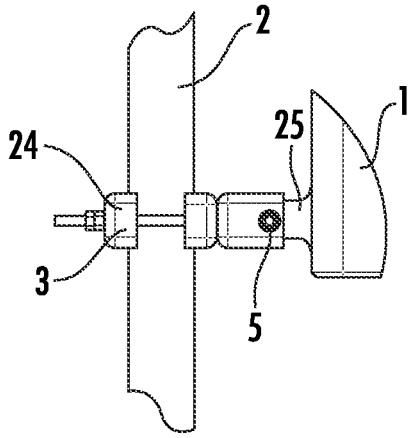
Figure 4C:
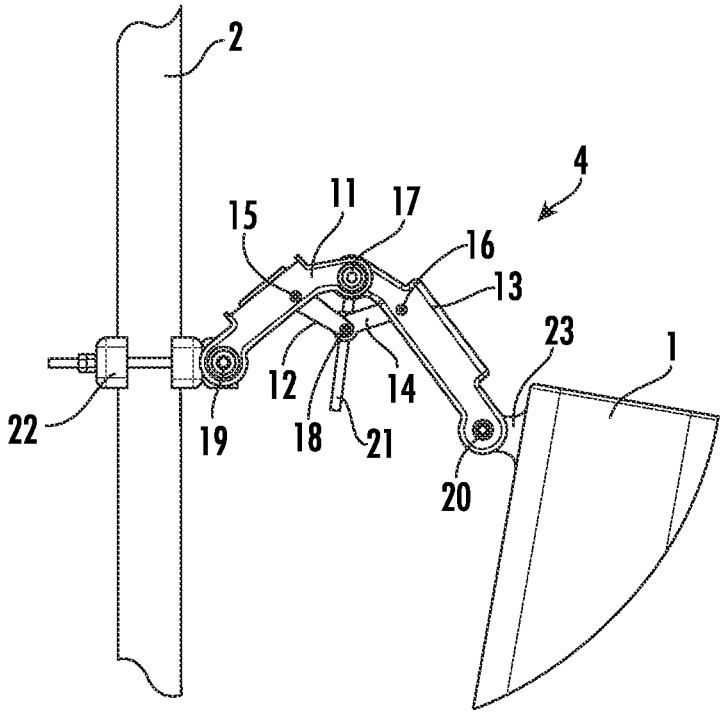
Figure 4D:
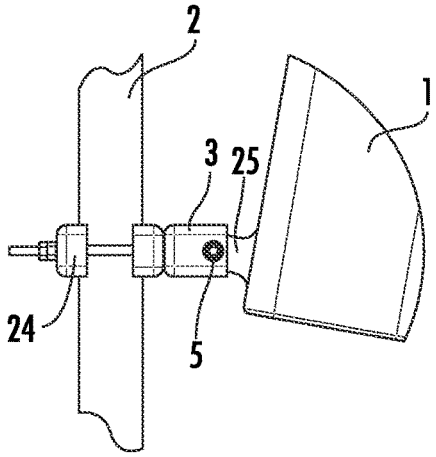
Figure 4E:
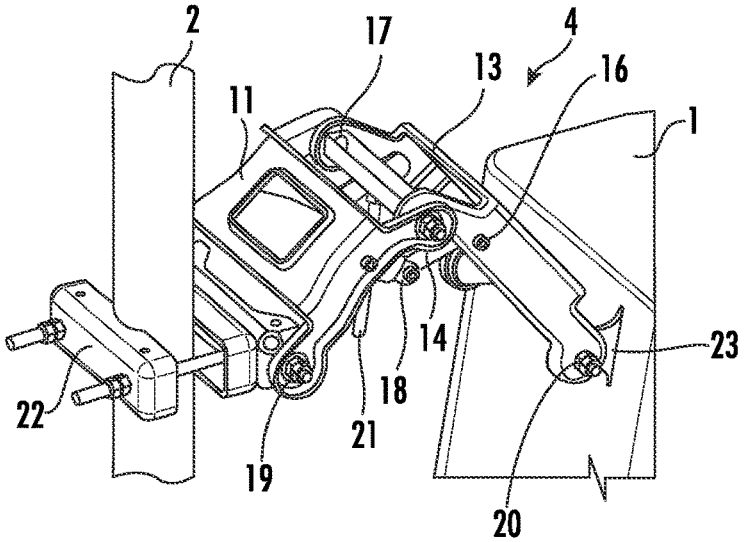
Figure 4F:
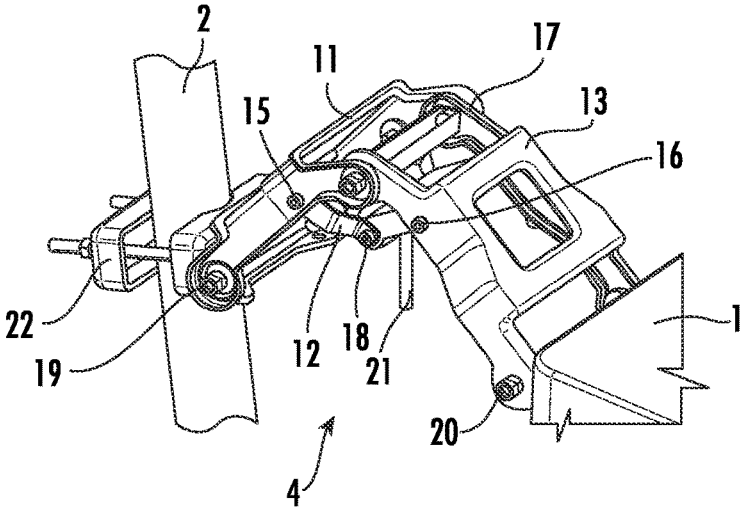

Firstly, the mounting assembly 4 for the base station antenna 1 according to the first embodiment of the present disclosure will be explained with reference to FIGS. 1 to 3 and 4A to 4F, wherein FIG. 1 is a side view of the base station antenna system with the mounting assembly 4 according to the first embodiment of the present disclosure when the mechanical tilt is zero, FIGS. 2 and 3 are side views and perspective views of the base station antenna system of FIG. 1 when it has a certain mechanical tilt, FIG. 4A is a detailed view of part A of FIG. 1, FIG. 4B is a detailed view of part B of FIG. 1, FIG. 4C is a detailed view of part C of FIG. 2, FIG. 4D is a detailed view of part D of FIG. 2, and FIGS. 4E and 4F are detailed views of part E of FIG. 3 from two different viewing angles.

As shown in FIG. 1 to FIG. 3, the base station antenna 1 is mounted to the holding pole 2 by means of the lower first mounting assembly 3 and the upper second mounting assembly 4. The first mounting assembly 3 is formed in a known manner and provides a pivot point 5 for the base station antenna. As shown in FIGS. 4B and 4D, the first mounting assembly 3 comprises a clamping device 24 for fastening to the holding pole 2 and a connecting element 25 for fixedly connecting to the base station antenna 1. The clamping device 24 and the connecting element 25 are hinged to each other, and thus provide a pivot point 5 for the base station antenna.

The second mounting assembly 4 is the mounting assembly for the base station antenna according to the first embodiment of the present disclosure, which has a continuously adjustable effective length, so that the base station antenna 1 has a continuously adjustable mechanical tilt. Now, the mounting assembly 4 according to the first embodiment of the present disclosure will be described in detail.

The mounting assembly 4 has a first connection part 19 for directly or indirectly connecting with the holding pole 2 and a second connection part 20 for directly or indirectly connecting with the base station antenna 1, wherein the effective length between the first connection part 19 and the second connection part 20 is related to the mechanical tilt of the base station antenna 1, and a larger effective length means a larger mechanical tilt. The mounting assembly 4 has, for example, a clamping device 22 for fastening to the holding pole 2, and the first connecting part 19 is connected with the clamping device 22. A connection element 23 fixedly connected to the base station antenna 1 is provided, and the second connection part 20 is connected to the fixed element 23.

The mounting assembly 4 comprises a connecting rod mechanism. The connecting rod mechanism has a first pair of connecting rods, and the two connecting rods 11 and 12 of the first pair are hinged to each other. The connecting rod mechanism has a second pair of connecting rods, and the two connecting rods 13 and 14 of the second pair are hinged to each other. One of the first connecting rods 11 of the first pair and one of the third connecting rods 13 of the second pair are hinged to each other to form a hinged connection part 17. The second connecting rod 12 of the first pair and the fourth connecting rod 14 of the second pair are hinged to each other to form a hinged connection part 18. The first connecting rod 11 and the third connecting rod 13 are hinged to each other at one end of each of them. The first connecting rod 11 and the third connecting rod 13 form the first connection part 19 and the second connection part 20 at the ends facing away from the hinged connection parts 17 thereof. The hinged connection part 15 between the first connecting rod 11 and the second connecting rod 12 is located between the hinged connection part 17 and the first connection part 19. The hinged connection part 16 of the third connecting rod 13 and the fourth connecting rod 14 is located between the hinged connection part 17 and the second connection part 20.

The mounting assembly 4 further comprises a threaded connection device 21, which can connect the hinged connection part 17 and the hinged connection part 18 with each other. By screwing the screw connection device 21, the distance between the hinged connection part 17 and the hinged connection part 18 can be continuously adjusted, and thus the effective length between the first connection part 19 and the second connection part 20 can be continuously adjusted, so as to continuously adjust the mechanical tilt of the base station antenna 1. The threaded connection device 21 can be rotated by means of a hand wrench or an electric tool.

In the first embodiment, the first connection part 19 and the second connection part 20 have first rotation axes parallel to each other, and the hinged connection parts 15-18 of the connecting rod mechanism have second rotation axes parallel to each other. Referring to FIG. 4C, the first rotation axis and the second rotation axis are perpendicular to the drawing plane.

Figure 5:
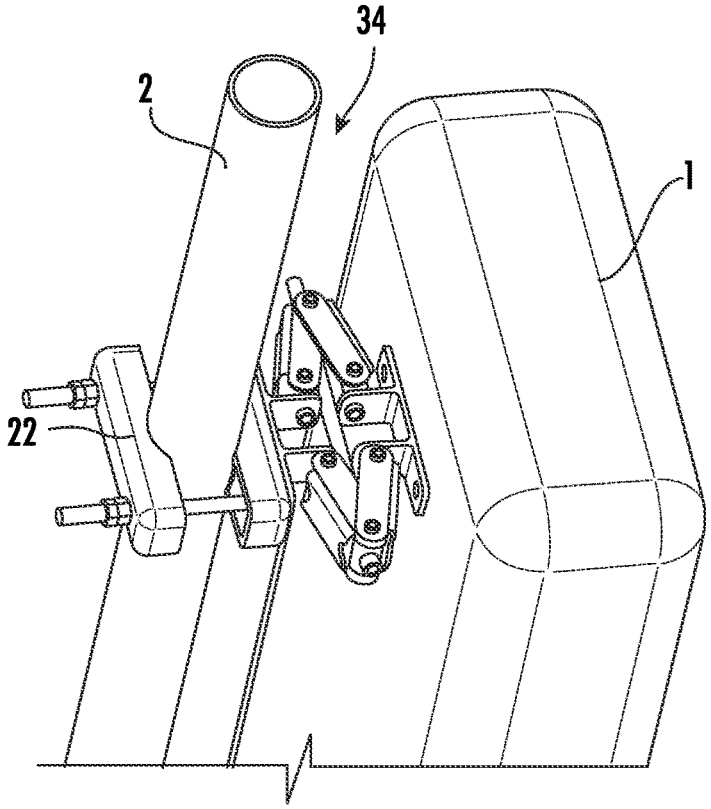
FIG. 5 and FIG. 6 are partial perspective views of the base station antenna system with the mounting assembly according to the second embodiment of the present disclosure at different mechanical tilts.
Figure 6:
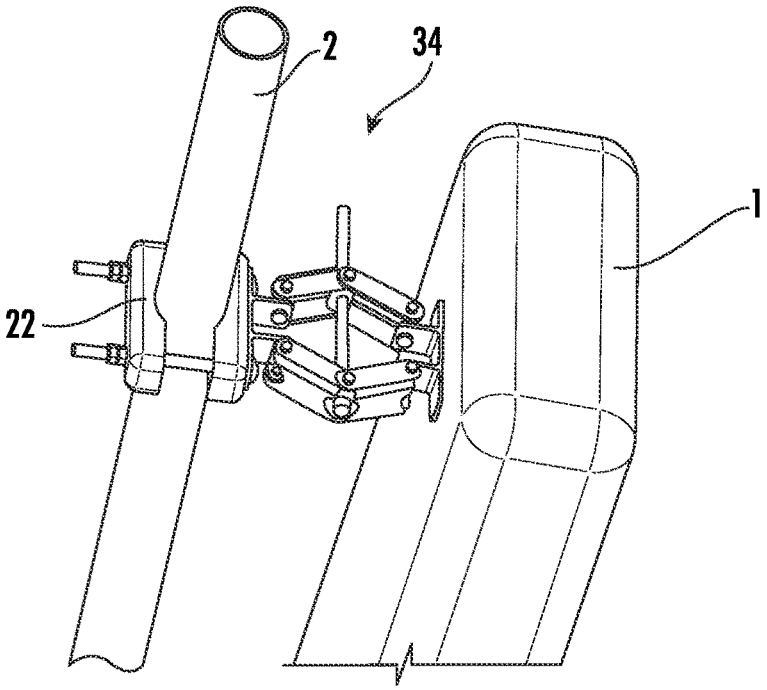
Figure 7:
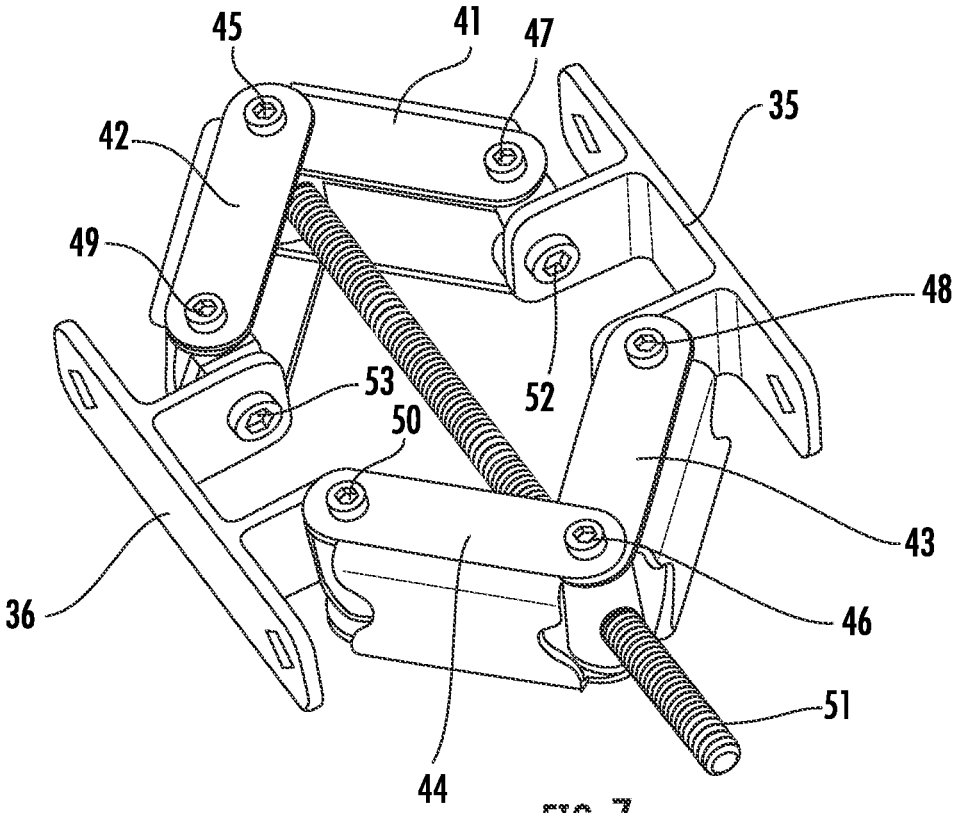
FIG. 7 is a perspective view of the mounting assembly according to the second embodiment of the present disclosure.

Next, the mounting assembly 34 according to the second embodiment of the present disclosure will be explained with reference to FIGS. 5 and 6, wherein FIG. 5 is a partial perspective view of the base station antenna system with the mounting assembly 34 according to the second embodiment of the present disclosure when the mechanical tilt is zero, and FIG. 6 is a partial perspective view of the base station antenna system when there is a certain mechanical tilt. The base station antenna 1 is pivotally connected with the holding pole 2 at the lower part. For this, please refer to FIGS. 1 to 3 and the description of the first embodiment.

The mounting assembly 34 according to the second embodiment has a first connection for directly or indirectly connecting with the holding pole 2 and a second connection for directly or indirectly connecting with the base station antenna, wherein the effective length between the first connection part and the second connection part is related to the mechanical tilt of the base station antenna.

The mounting assembly 34 comprises a connecting rod mechanism. The connecting rod mechanism has a first pair of connecting rods, and the two connecting rods 41 and 42 of the first pair are hinged to each other to form a hinged connection part 45. The connecting rod mechanism has a second pair of connecting rods, and the two connecting rods 43 and 44 of the second pair are hinged to each other to form a hinged connection part 46. One of the first connecting rods 41 of the first pair and one of the third connecting rods 43 of the second pair are movably connected with the first mounting member 35. More specifically, the first connecting rod 41 and the third connecting rod 43 are movably connected with the first mounting member 35 through a first combined hinged connection part including a first U-shaped element, the first connecting rod 41 or the third connecting rod 43 is pivotally hinged with two legs of the first U-shaped element around a second rotation axis to form a hinged connection part 47, and the first mounting member 35 is pivotally hinged with the bottom of the first U-shaped element around a second rotation axis to form a hinged connection part 52. The first rotation axis and the second rotation axis can be perpendicular to each other. The second connecting rod 42 of the first pair and the fourth connecting rod 44 of the second pair can be movably connected with the second mounting member 36. More specifically, the second connecting rod 42 and the fourth connecting rod 44 are movably connected with the second mounting member 36 through a second combined hinged connection part including a second U-shaped element, the second connecting rod 42 or the fourth connecting rod 44 is pivotally hinged with two legs of the second U-shaped element around a second rotation axis, and the second mounting member is connected with the bottom of the second U-shaped element to form a hinged connection part 53. The first rotation axis and the second rotation axis can be perpendicular to each other. The first mounting member 35 constitutes a second connection part, and the second mounting member 36 constitutes a first connection part. The first mounting member 35 has a plate-shaped bottom surface and two connecting legs extruding from the bottom surface, the first connecting rod 41 is connected with one of the connecting legs, and the third connecting rod 43 is connected with the other connecting leg. The second mounting member 36 has a plate-shaped bottom surface and two connecting legs extruding from the bottom surface, the second connecting rod 42 is connected with one of the connecting legs, and the fourth connecting rod 44 is connected with the other connecting leg. The bottom surface of the first mounting member 35 is fixed on the base station antenna 1. The bottom surface of the second mounting member 36 is fixed on the clamping device 22.

The mounting assembly 34 further comprises a threaded connection device 51, which can connect the hinged connection part 45 and the hinged connection part 46 with each other. By screwing the screw connection device 51, the distance between the hinged connection part 45 and the hinged connection part 46 can be continuously adjusted, and thus the effective length between the first connection part and the second connection part can be continuously adjusted, making it possible to continuously adjust the mechanical tilt of the base station antenna 1. The threaded connection device 51 can be screwed by means of a hand wrench or an electric tool.

In the second embodiment, the first connection part and the second connection part have mutually parallel first rotation axes (rotation axes confined by the hinged connection parts 52 and 53), and a plurality of hinged connection parts 45 to 50 of the connecting rod mechanism have mutually parallel second rotation axes, which are perpendicular to each other.

Figure 8:
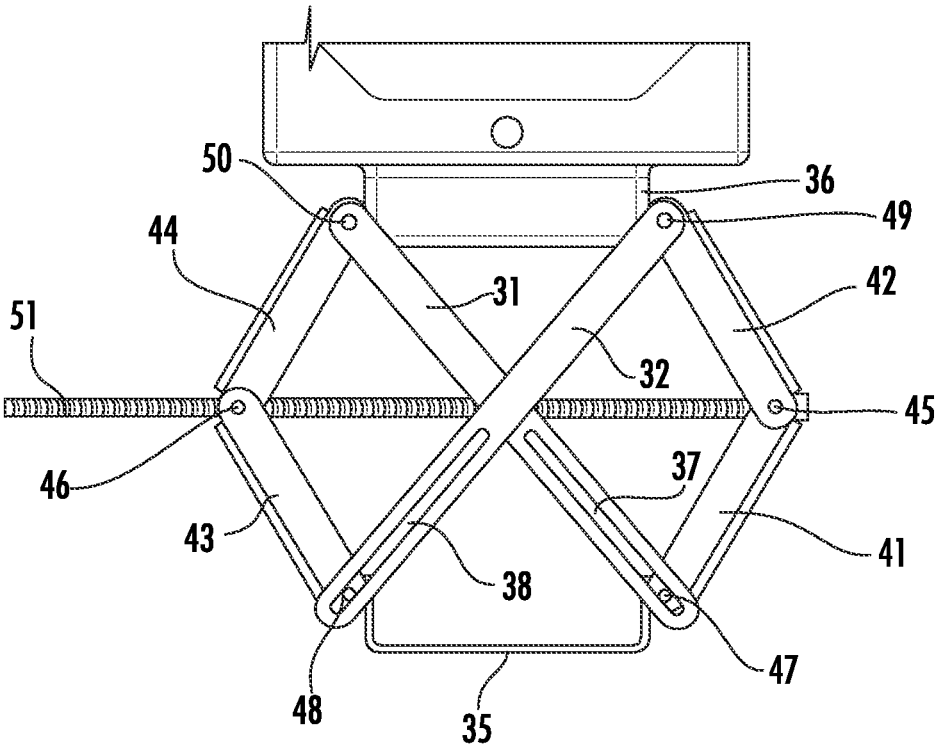
FIG. 8 and FIG. 9 are schematic diagrams of the mounting assembly according to the third embodiment of the present disclosure in different states.
Figure 9:
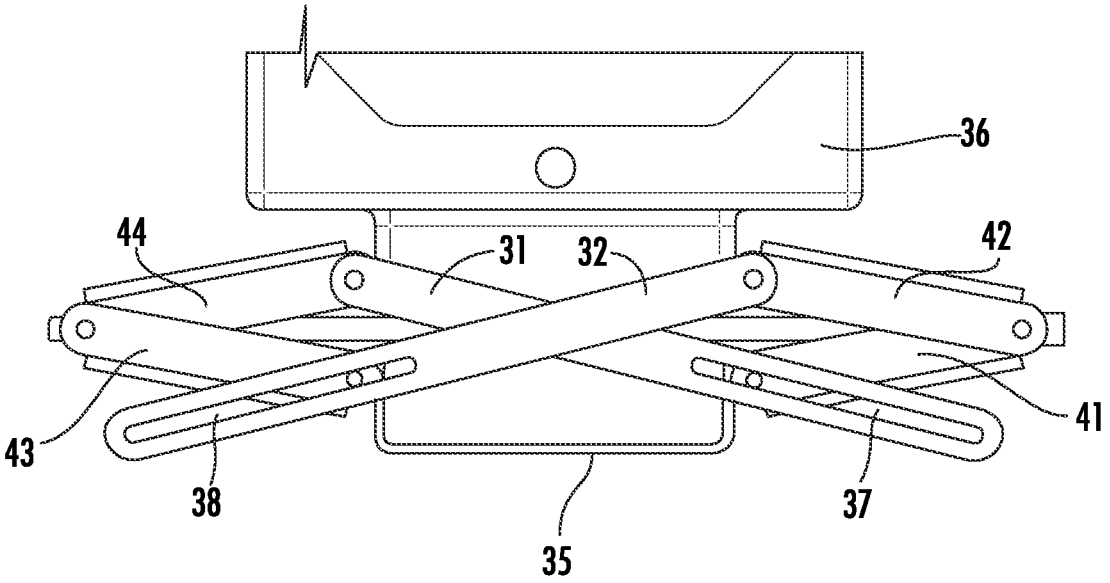

FIG. 8 and FIG. 9 are schematic diagrams of the mounting assembly according to the third embodiment of the present disclosure in two different states, wherein the state shown in FIG. 8 corresponds to the case where the adjustable mechanical tilt of the base station antenna is at maximum, and the state shown in FIG. 9 corresponds to the case where the mechanical tilt of the base station antenna is zero. The third embodiment starts from the second embodiment and is additionally provided with a first additional connecting rod 31 and a second additional connecting rod 32. The first additional connecting rod 31 has a long hole 37. The first additional connecting rod 31 is connected with the hinged connection part 50 between the fourth connecting rod 44 and the second U-shaped element, and the hinged connection part 47 between the first connecting rod 41 and the first U-shaped element is movable in the long hole 37 of the first additional connecting rod 31. The second additional connecting rod 32 has a long hole 38. The second additional connecting rod 32 is connected with the hinged connection part 49 between the second connecting rod 42 and the second U-shaped element, and the hinged connection part 48 between the third connecting rod 43 and the first U-shaped element is movable in the long hole 38 of the second additional connecting rod 32. When one end of the long hole 37 of the first additional connecting rod 31 contacts the hinged connection part 47 and one end of the long hole 38 of the second additional connecting rod 32 contacts the hinged connection part 48, the maximum effective length between the first connection part and the second connection part is restricted, wherein the first additional connecting rod 31 and the second additional connecting rod 32 provide additional support to the base station antenna 1. The first additional connecting rod 31 and the second additional connecting rod 32 can contribute to the bearing capacity of the mounting assembly for the base station antenna 1.

It will be understood that, the terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprise" and "include" (and variants thereof), when used in this specification, specify the presence of stated operations, elements, and/or components, but do not preclude the presence or addition of one or more other operations, elements, components, and/or groups thereof. As used herein, the term "and/or" includes any and all combinations of one or more of the associated listed items. Like reference numbers signify like elements throughout the description of the figures.

The thicknesses of elements in the drawings may be exaggerated for the sake of clarity. Further, it will be understood that when an element is referred to as being "on," "coupled to" or "connected to" another element, the element may be formed directly on, coupled to or connected to the other element, or there may be one or more intervening elements therebetween. In contrast, terms such as "directly on," "directly coupled to" and "directly connected to," when used herein, indicate that no intervening elements are present. Other words used to describe the relationship between elements should be interpreted in a like fashion (i.e., "between" versus "directly between", "attached" versus "directly attached," "adjacent" versus "directly adjacent", etc.).

Terms such as "top," "bottom," "upper," "lower," "above," "below," and the like are used herein to describe the relationship of one element, layer or region to another element, layer or region as illustrated in the figures. It will be understood that these terms are intended to encompass different orientations of the device in addition to the orientation depicted in the figures.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

It will also be appreciated that all example embodiments disclosed herein can be combined in any way.

Finally, it is to be noted that, the above-described embodiments are merely for understanding the present invention but not constitute a limit on the protection scope of the present invention. For those skilled in the art, modifications may be made on the basis of the above-described embodiments, and these modifications do not depart from the protection scope of the present invention.

The invention claimed is:

1. A mounting assembly for a base station antenna, comprising a first connection and a second connection for directly or indirectly connecting with the base station antenna, wherein an effective length between the first connection and the second connection is related to a mechanical tilt of the base station antenna, and the effective length is continuously adjustable, wherein the mounting assembly comprises a connecting rod mechanism having:

a first pair of connecting rods, the two first connecting rods being hinged to each other; and a second pair of connecting rods, the two second connecting rods being hinged to each other;

wherein a first connecting rod of the first pair and a third connecting rod of the second pair are hinged to each other or movably connected with a first mounting member;

wherein a second connecting rod of the first pair and a fourth connecting rod of the second pair are hinged to each other or movably connected with a second mounting member;

wherein the mounting assembly also comprises:

a threaded connection device which connects two relatively movable hinged connections of the connecting rod mechanism, wherein the distance between the two relatively movable hinged connections can be continuously adjusted by rotating the threaded connection device and thus the effective length between the first and the second connection can be continuously adjusted, and wherein the first connection and the second connection have mutually parallel first rotation axes, and a plurality of hinged connections of the connecting rod mechanism have mutually parallel second rotation axes, and wherein the first rotation axes and the second rotation axes are perpendicular to each other.

2. The mounting assembly for a base station antenna according to claim 1, wherein the first connecting rod and the third connecting rod are hinged to each other, and the second connecting rod and the fourth connecting rod are hinged to each other, and the hinged connection between the first connecting rod and the third connecting rod and the hinged connection part between the second connecting rod and the fourth connecting rod constitute the two relatively movable hinged connections.

3. The mounting assembly for a base station antenna according to claim 2, wherein the first connecting rod and the third connecting rod provide the first connection and the second connection at the ends facing away from the hinged connection thereof.

4. The mounting assembly for a base station antenna according to claim 1, wherein the first connecting rod and the third connecting rod are movably connected with the first mounting member, the second connecting rod and the fourth connecting rod are movably connected with the second mounting member, the first mounting member constitutes the second connection, the second mounting member constitutes the first connection, and the hinged connection between the first and second connecting rods and the hinged connection between the third and fourth connecting rods constitute the two relatively movable hinged connection part.

5. The mounting assembly for a base station antenna according to claim 4, wherein the first connecting rod and the third connecting rod are movably connected with the first mounting member through a first complex hinged connection including a first U-shaped element, and the first connecting rod or the third connecting rod is pivotally hinged with two legs of the first U-shaped element around a second rotation axis, the first mounting member is pivotally hinged with a bottom of the first U-shaped element around a first rotation axis, and the first rotation axis is perpendicular to the second rotation axis; and/or the second connecting rod and the fourth connecting rod are movably connected with the second mounting member through a second complex hinged connection including a second U-shaped element, the second connecting rod or the fourth connecting rod is pivotally hinged with two legs of the second U-shaped element around a second rotation axis, and the second mounting member is pivotally hinged with a bottom of the second U-shaped element around a first rotation axis, and the first rotation axis is perpendicular to the second rotation axis.

6. The mounting assembly for a base station antenna according to claim 5, wherein the connecting rod mechanism comprises a first additional connecting rod having a long hole, the first additional connecting rod is connected with one of four hinged connections, another of the four hinged connections is movable in the long hole, and the four hinged connection parts comprise the hinged connection between the first connecting rod and the first U-shaped element, the hinged connection between the third connecting rod and the first U-shaped element, the hinged connection between the second connecting rod and the second U-shaped element, and the hinged connection between the fourth connecting rod and the second U-shaped element.

7. The mounting assembly for a base station antenna according to claim 6, wherein the first additional connecting rod is connected with the hinged connection between the fourth connecting rod and the second U-shaped element, and the hinged connection between the first connecting rod and the first U-shaped element is movable in the long hole of the first additional connecting rod.

8. The mounting assembly for a base station antenna according to claim 7, wherein the connecting rod mechanism comprises a second additional connecting rod which has a long hole, the second additional connecting rod is connected with the hinged connection between the second connecting rod and the second U-shaped element, and the hinged connection between the third connecting rod and the first U-shaped element is movable in the long hole of the second additional connecting rod.

9. The mounting assembly for a base station antenna according to any of claim 1, wherein the first mounting member has a plate-shaped bottom surface and two connecting legs extruding from the bottom surface, the first connecting rod is connected with one of the connecting legs, and the third connecting rod is connected with the other connecting leg.

10. The mounting assembly for a base station antenna according to claim 1, wherein the second mounting member has a plate-shaped bottom surface and two connecting legs extruding from the bottom surface, the second connecting rod is connected with one of the connecting legs, and the fourth connecting rod is connected with the other connecting leg.

11. A mounting kit for a base station antenna, comprising a first mounting assembly and a second mounting assembly, wherein the first mounting assembly is configured to provide a pivot point of the base station antenna on a pole, and the second mounting assembly is the mounting assembly according to claim 1, and is configured to provide a continuously adjustable effective length between the base station antenna and the pole, so that the mechanical tilt of the base station antenna can be continuously adjusted.

12. A mounting assembly for a base station antenna, comprising:

a first connection and a second connection for directly or indirectly connecting with the base station antenna, wherein an effective length between the first connection and the second connection is related to a mechanical tilt of the base station antenna, and the effective length is continuously adjustable;

a connecting rod mechanism extending between the first and second connections, the connecting rod mechanism including:

a first connecting rod being hingedly connected to a second connecting rod to form a first hinged connection;

a third connecting rod being hingedly connected to a fourth connecting rod to form a second hinged connection;

a fifth connecting rod having a first long hole; and a sixth connecting rod having a second long hole;

wherein the first connecting rod and the third connecting rod are movably connected with a first mounting member, wherein the second connecting rod and the fourth connecting rod are movably connected with a second mounting member, wherein the fifth connecting rod is movably connected to the first mounting member through the first long hole and hingedly connected to the second mounting member, and wherein the sixth connecting rod is movably connected to the first mounting member through the second long hole and hingedly connected to the second mounting member; and a threaded connection device which connects two relatively movable hinged connections of the connecting rod mechanism, wherein the distance between the two relatively movable hinged connections can be continuously adjusted by rotating the threaded connection device and thus the effective length between the first and the second connection can be continuously adjusted.

13. The mounting assembly for a base station antenna according to claim 12, wherein the first mounting member constitutes the first connection, the second mounting member constitutes the second connection, and the first hinged connection and the second hinged connection constitute the two relatively movable hinged connections.

14. The mounting assembly for a base station antenna according to claim 12, wherein the first connecting rod and the third connecting rod are movably connected with the first mounting member through a first complex hinged connection including a first U-shaped element, and the first connecting rod or the third connecting rod is pivotally hinged with two legs of the first U-shaped element around a second rotation axis, the first mounting member is pivotally hinged with a bottom of the first U-shaped element around a first rotation axis, and the first rotation axis is perpendicular to the second rotation axis; and/or the second connecting rod and the fourth connecting rod are movably connected with the second mounting member through a second complex hinged connection including a second U-shaped element, the second connecting rod or the fourth connecting rod is pivotally hinged with two legs of the second U-shaped element around a second rotation axis, and the second mounting member is pivotally hinged with a bottom of the second U-shaped element around a first rotation axis, and the first rotation axis is perpendicular to the second rotation axis.

15. The mounting assembly for a base station antenna according to claim 14, wherein the connecting rod mechanism comprises four hinged connection parts, wherein the fifth connecting rod is connected with a first hinged connection part, a second hinged connection part is movable in the long hole of the fifth connecting rod, the sixth connecting rod is connected with a third hinged connection part, and a fourth hinged connection part is movable in the long hole of the sixth connecting rod.

16. The mounting assembly for a base station antenna according to claim 15, wherein the four hinged connection parts comprise a third hinged connection between the first connecting rod and the first U-shaped element, a fourth hinged connection between the third connecting rod and the first U-shaped element, a fifth hinged connection between the second connecting rod and the second U-shaped element, and a sixth hinged connection between the fourth connecting rod and the second U-shaped element.

17. The mounting assembly for a base station antenna according to claim 16, wherein the fifth connecting rod is connected with the sixth hinged connection between the fourth connecting rod and the second U-shaped element, and the third hinged connection between the first connecting rod and the first U-shaped element is movable in the long hole of the fifth connecting rod.

18. The mounting assembly for a base station antenna according to claim 16, wherein the sixth connecting rod is connected with the fifth hinged connection between the second connecting rod and the second U-shaped element, and the fourth hinged connection between the third connecting rod and the first U-shaped element is movable in the long hole of the sixth connecting rod.

19. The mounting assembly for a base station antenna according to claim 18, wherein the first mounting member has a plate-shaped bottom surface and two connecting legs extruding from the bottom surface, the first connecting rod is connected with one of the connecting legs, and the third connecting rod is connected with the other connecting leg.

20. The mounting assembly for a base station antenna according to claim 19, wherein the second mounting member has a plate-shaped bottom surface and two connecting legs extruding from the bottom surface, the second connecting rod is connected with one of the connecting legs, and the fourth connecting rod is connected with the other connecting leg.

21. A mounting assembly for a base station antenna, comprising:

a first mounting member;

a second mounting member;

a connecting rod mechanism extending between the first and second mounting members, the connecting rod mechanism including:

a first connecting rod being hingedly connected to a second connecting rod to form a first hinged connection;

a third connecting rod being hingedly connected to a fourth connecting rod to form a second hinged connection;

a fifth connecting rod having a first elongated aperture; and a sixth connecting rod having a second elongated aperture;

wherein the first connecting rod and the third connecting rod are movably connected with the first mounting member to form a first connection, wherein the second connecting rod and the fourth connecting rod are movably connected with the second mounting member to form a second connection, wherein the fifth connecting rod is movably connected to the first mounting member through the first elongated aperture and hingedly connected to the second mounting member, and wherein the sixth connecting rod is movably connected to the first mounting member through the second elongated aperture and hingedly connected to the second mounting member; and a threaded connection device which connects the first and second hinged connections of the connecting rod mechanism, wherein a distance between the first mounting member and the second mounting member is adjustable through rotation of the threaded connection device.

22. The mounting assembly for a base station antenna according to claim 21, wherein the distance between the first mounting member and the second mounting member is related to a mechanical tilt of the base station antenna.

23. The mounting assembly for a base station antenna according to claim 21, wherein the first connection and the second connection have mutually parallel first rotation axes, and the first hinged connection and the second hinged connection of the connecting rod mechanism have parallel second rotation axes, and wherein the first and second rotation axes are perpendicular to each other.

* * * * *